US005461231A

United States Patent [19]

Sugimoto et al.

[11] Patent Number: 5,461,231

[45] Date of Patent: Oct. 24, 1995

[54] PASSIVE TYPE MOVING OBJECT DETECTION SYSTEM

[75] Inventors: Tadashi Sugimoto, Shiga; Shingo Ohkawa, Otsu; Hiroyuki Amano, Otsu; Masashi Iwasawa, Otsu; Shinya Kawabuchi, Otsu; Norikazu Murata, Otsu, all of Japan

[73] Assignee: Optex Co. Ltd., Shiga, Japan

[21] Appl. No.: 241,309

[22] Filed: May 10, 1994

[30] Foreign Application Priority Data

May 11, 1993 [JP] Japan ..... 5-109618
Sep. 10, 1993 [JP] Japan ..... 5-226058

[51] Int. Cl.[6] ..... G08B 13/18

[52] U.S. Cl. ..... 250/342; 250/349; 250/DIG. 1

[58] Field of Search ..... 250/342, 349, 250/DIG. 1, 338.3; 340/567

[56] References Cited

U.S. PATENT DOCUMENTS 4,618,854 10/1986 Miyake et al. ..... 250/342
4,912,748 3/1990 Horii et al. ..... 250/342

FOREIGN PATENT DOCUMENTS 124787 5/1989 Japan ..... 250/338.3

*Primary Examiner*—Carolyn E. Fields
*Attorney, Agent, or Firm*—Panitch Schwarze Jacobs & Nadel

[57] ABSTRACT

A passive-type moving object detection system is disclosed. The system includes an infrared detector, infrared sensors mounted on the infrared detector, a detection field including two columns of detection regions for monitoring a human intruder and two rows of detection regions for detecting a non-human intruder. The columns have a height corresponding to a human height, and an optical system is located between the infrared detector and the detection field. The infrared sensors have infrared accepting areas that include first and second sections. The first section optically corresponds to the columns and the second section optically corresponds to the rows. Each sensor receives infrared radiation from a moving object passing through the detection regions. The detector includes an arithmetic circuit that subtracts the peak values of signals generated by the detector and a decision circuit to compare the result with a reference level.

7 Claims, 20 Drawing Sheets e
Arithmetic Unit
2nd Circuit
d
1st Circuit
c
a
b
Optical System
2
Ah
Av
Av
Am e
Arithmetic Unit
2nd Circuit
d'
1st Circuit
c
a
b
Optical System
2
Ah
Av
Av
Am The passage of a human The passage of an animal The passage of a human The passage of an animal Fig. 31 (A)
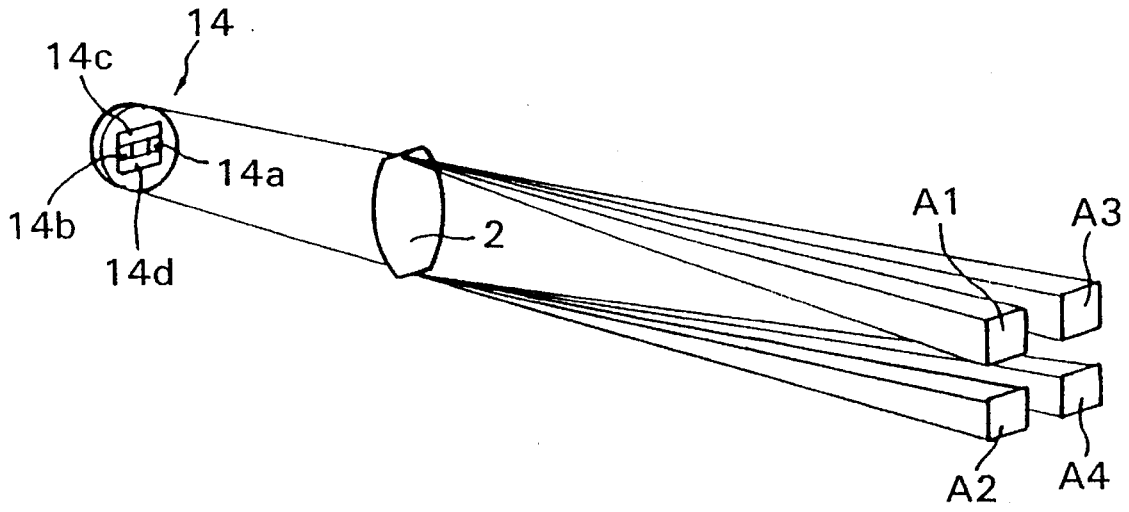
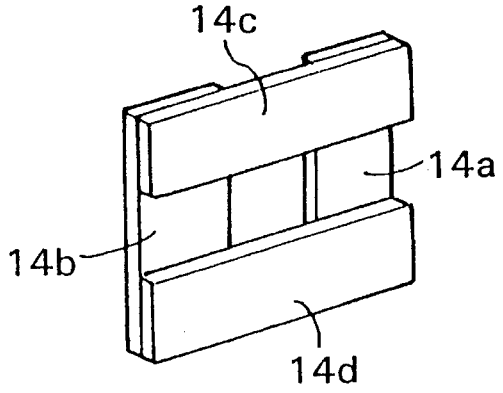
Fig. 31 (B)

PASSIVE TYPE MOVING OBJECT DETECTION SYSTEM

FIELD OF THE INVENTION

The present invention relates generally to a passive type moving object detection system, and more particularly to a moving object detection system for detecting any change in the energy level from the detection region in accordance with the intrusion, wherein the "passive type" is a type which does not use a source of radiant energy but utilizes the radiation of infrared generated by the intruder. Herein, the moving object includes not only intruders but also visiting guests.

BACKGROUND OF THE INVENTION

Passive type detection systems are known and widely used. The passive type system is based on a phenomenon that a living thing radiates infrared having an intensity according to the body temperature. The known system is constructed to focus infrared radiating from a human passing through a predetermined detection region, and transmits a focused ray to an infrared detecting element whereby a change in the level of infrared energy from the detection region is converted into voltage so as to output a signal. If the signal is found to exceed a reference value, any form of alarm is given. Such detection systems are used not only as intrusion detection systems but also as switches at automatic doors to know in advance that a visiting guest has arrived.

A problem of the known detection system is that it is likely to produce an alarm owing to a sudden rise in the ambient temperature around the detection region caused by strong wind, microwave noise, sunlight, or any other interference. In order to prevent the production of false signal, an error preventive device is provided, which will be described by reference to FIG. 12:

A detector 1 is provided with a pair of infrared sensors 1*a* and 1*b* (three or more sensors can be used) which are arranged in parallel or in series with opposite polarity. An optical system 2 is located and detection regions E1 and E2 having a human height are set up.

When a human H or a dog M passes through the detection regions E1 and E2, it cannot instantly pass through the two regions. A time interval from the region E1 to the region E2 is unavoidable. This is a different point from ambient interference such as sunlight which covers the two regions E1 and E2 simultaneously. The outputs from the regions E1 and E2 due to ambient interference are mutually negated because of the differential electrical connection, thereby avoiding the production of false alarm. When a human intruder H passes through the detection regions E1 and E2, the human covers the whole space of each detection region E1 and E2, thereby outputting a signal at a level higher than the reference level. If a moving object is not a human but an animal such as a dog or a cat shorter than a human, it only covers a lower part of the detection regions E1 and E2, thereby outputting a signal at a lower level than the reference level. Thus the production of a false alarm is avoided.

When a difference between the temperature of a moving object and the ambient temperature is small, a false signalling can be avoided as shown in FIGS. 13 and 14. The signal output by a human H is higher than a reference level as shown in FIG. 13(*a*) whereas the signal output by a small animal M is lower than the reference level as shown in FIG. 14(*a*). When the difference is large, a false signal is likely to occur as shown in FIG. 13(*b*), because the signal output by a dog M exceeds the reference level. As is evident from FIGS. 13(*b*) and 14(*b*), it is difficult to ascertain whether the moving object is a human or an animal. If any object other than a human is detected and signalled, a fuss may occur.

SUMMARY OF THE INVENTION

The present invention is to provide a passive type moving object detection system capable of avoiding the production of a false alarm due to the detection of an object other than a human.

According to the present invention, there is provided a passive type moving object detection system which include an infrared detector, infrared sensors mounted on the infrared detector, a detection field including a column of detection regions for monitoring a human intruder and a row of detection regions for detecting a non-human intruder, wherein the column of detection regions have a height covering a human height, an optical system located between the infrared detector and the detection field, the infrared sensors having infrared accepting areas comprising a first section and a second section wherein the first section optically corresponds to the column of detection region and the second section optically corresponds to the row of detection region, so as to receive infrared ray radiating from a moving object passing through the detection regions, and the detector including an arithmetic circuit which makes subtraction between the peak values of signals generated by the detector, and a decision circuit whereby the balance of subtraction is compared with a reference level.

The passage of a human (an intruder or a visiting guest) through the vertically arranged detection regions causes the detector to generate a high peak signal, and the subsequent passage through the horizontally arranged detection regions causes the detector to generate a low peak signal. Subtraction is made between the two signals at the arithmetic circuit, and the resulting value exceeds the reference value. If an animal passes in the same manner through the detection regions, the resulting signal is lower than the reference value or has a level nearly equal to zero, thereby failing to perform a warning system. Thus the production of a false alarm is avoided.

BRIEF DESCRIPTION OF THE DRAWINGS

FIGS. 31(A) and 31(B) are a diagrammatic view exemplifying an optical arrangement used in the sixth example.

DETAILED DESCRIPTION OF THE PREFERRED EMBODIMENT

Figure 1:
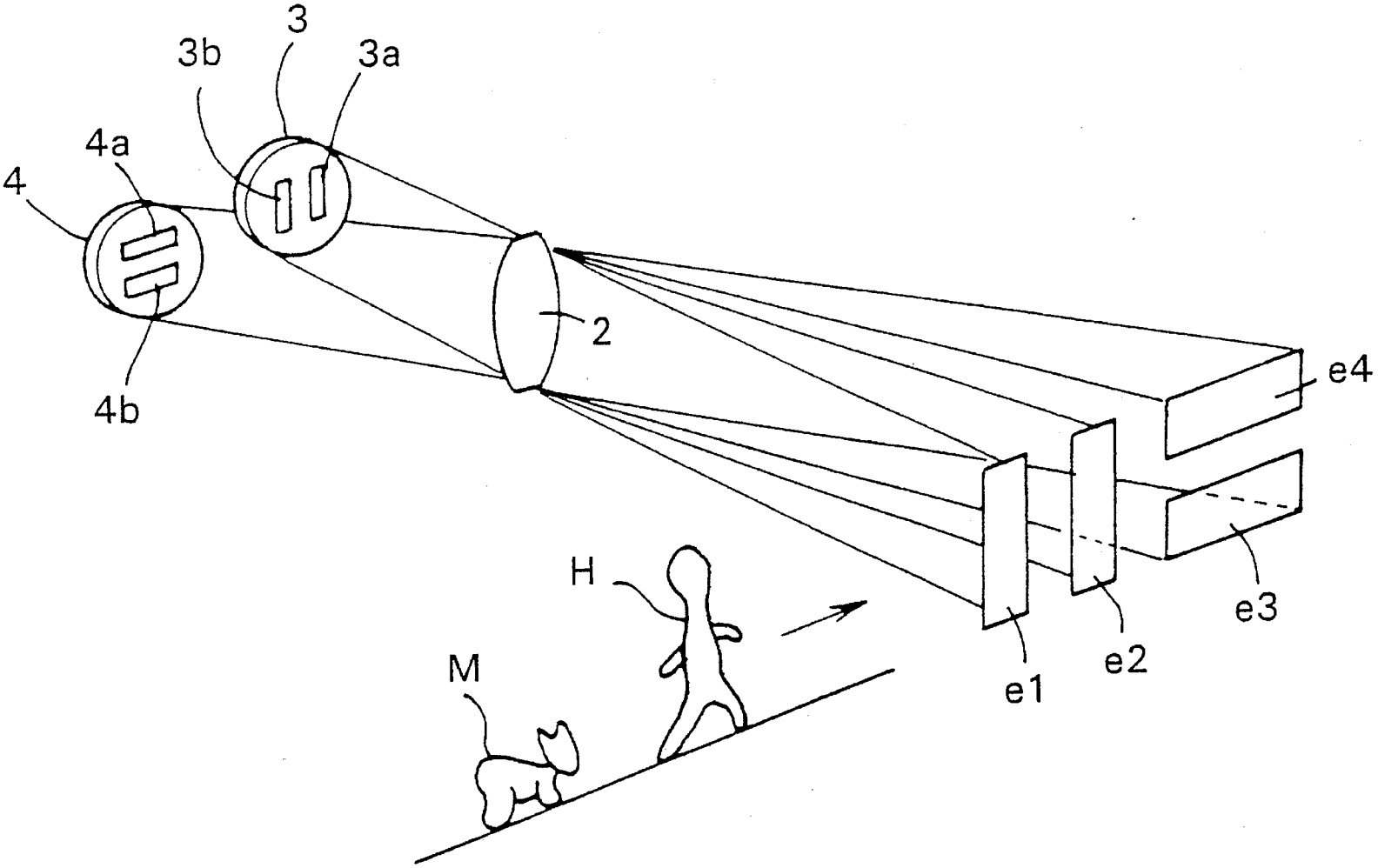
FIG. 1 is a diagrammatic view exemplifying the principle underlying the present invention.

Referring to FIG. 1, one embodiment of the present invention will be described:

The exemplary system includes infrared detectors 3 and 4 arranged in parallel, an optical system 2, and detection regions e1, e2, e3, and e4 of which the regions e1 and e2 are spaced from each other and are vertically arranged covering a human height. The detector 3 is provided with a pair of pyroelectric infrared sensors 3*a* and 3*b* optically correspond to the detection regions e1 and e2. The detector 4 is provided with a pair of pyroelectric infrared sensors 4*a* and which optically correspond to the detection regions e3 and e4 spaced from each other and horizontally arranged.

Figure 2:
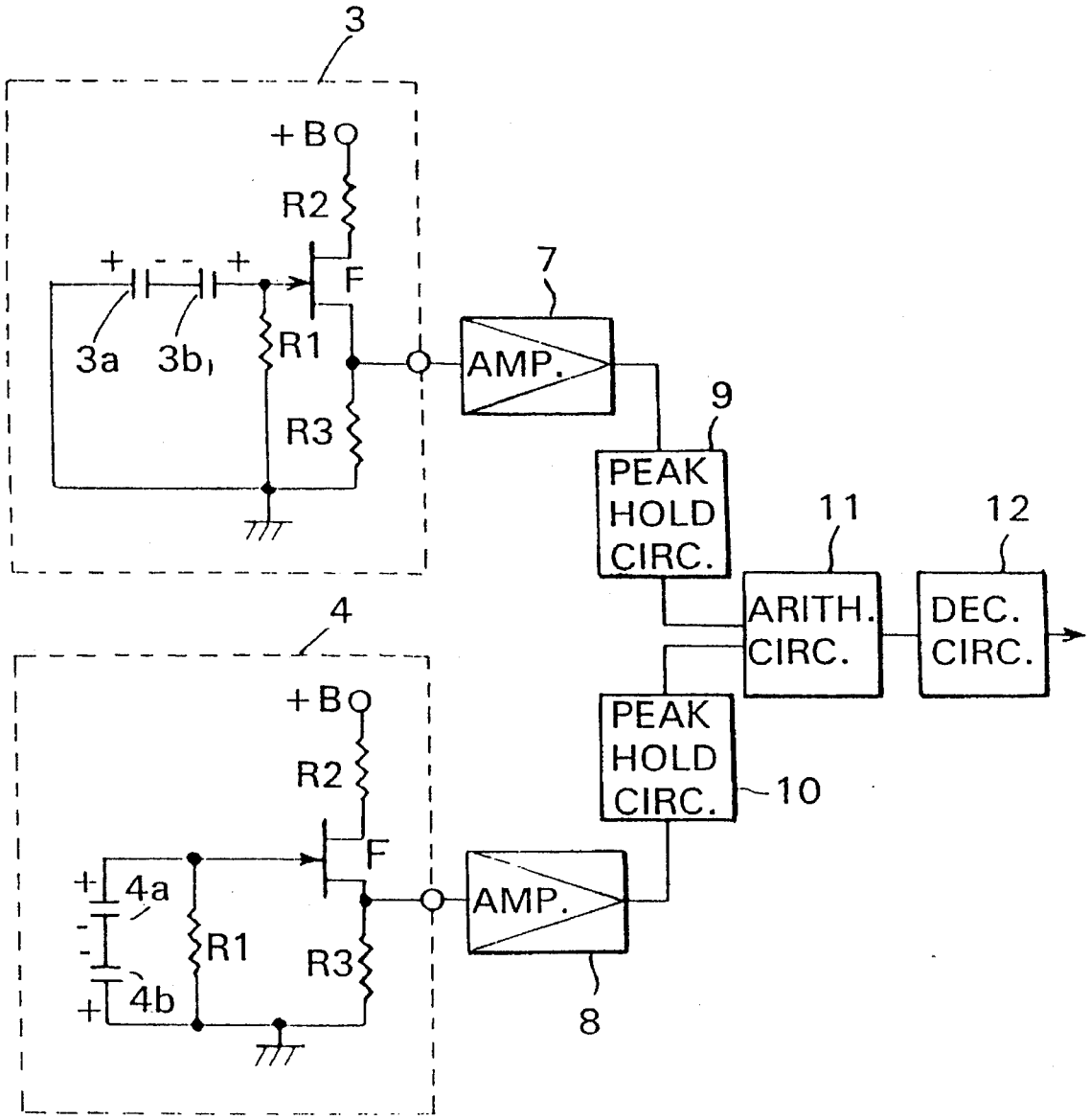
FIG. 2 is a circuit diagram used in the system of FIG. 1.

As shown in FIG. 2, the detectors 3 and 4 have substantially the same structure in which the sensors 3*a*, 3*b* and 4*a*, 4*b* are respectively connected in series to each other with opposite polarity. They receive incident infrared ray focused by the optical system 2, and output a signal in accordance with changes in the energy level incident thereto. Electric charge accumulating owing to the incidence of infrared ray is discharged through a resistance R1, and is subjected to impedance conversion by a field-effect transistor F. The signal is amplified through amplifying resistances R2 and R3 connected in series to a d.c. source +B.

The signals output by the detectors 3 and 4 are respectively amplified by the amplifiers 7 and 8, and + (plus) peak and − (minus) peak values of each signal are temporarily held by peak holding circuits 9 and 10. An arithmetic circuit 11 subtracts a lower peak value form a higher peak value, and the resulting value is compared with a reference level at a decision circuit 12. If the signal is found to exceed the reference level, it indicates that the intruder is a human.

Figure 3:
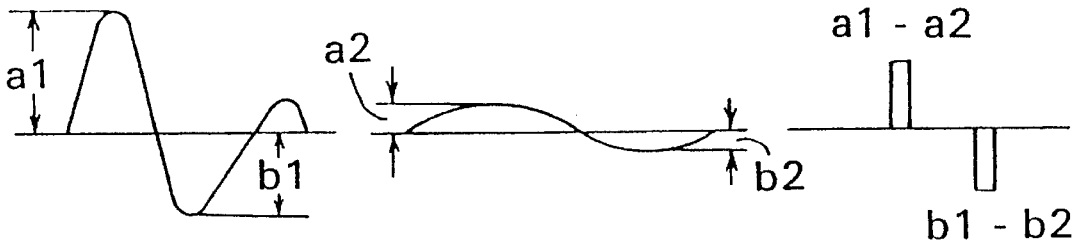
FIGS. 3(*a*) to 3(*c*) show the waveforms of signals generated when a human passes; through detection regions.

FIG. 3 illustrates the waveforms obtained when a human H passes through the detection regions.

A human H passes through the detection regions e1 and e2 at a time interval. A change in the level of infrared energy from the regions e1 and e2 is respectively detected by the sensors 3*a* and 3*b*. The detector B generates two signals having a plus peak value a1 and a minus peak value b1 (FIG. 3(*a*)). Then, the human H moves on to the regions e3 an e4 and simultaneously passes through them because the regions e3 and e4 are horizontally arranged one above another. The outputs from the sensors 4*a* and 4*b* are mutually negated because of the differential electrical connection,-and the resulting outputs have low peaks values a2 and b2 as shown in FIG. 3(*b*). These peak values a1, b1, a2, and a2 are held by the holding circuits 9 and 10, and subtraction is made at the arithmetic circuit 11. As a result, as shown in FIG. 3(*c*), high level signals a1, a2 and b1, b2 are obtained. The decision circuit 12 compares the resulting signals with a reference value, and if it founds that the resulting signal exceeds the reference value, an alarm is given.

Figure 4:
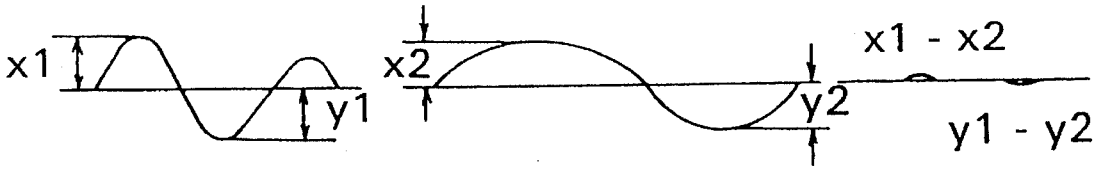
FIGS. 4(*a*) to 4(*c*) show the waveforms of signals generated when an animal passes through detection regions.

FIG. 4 illustrates the waveforms obtained when a dog H passes through the detection regions.

The dog M, because of its short height, passes only through a lower part of each region e1 and e2. A plus signal x1 and a minus signal y2 output by the detector 3 is low (FIG. 4(*a*)) as compared with the case of FIG. 3. In the regions e3 and e4 the animal M fails to reach the upper region e4 but covers the lower region e3 alone. As shown in FIG. 4(*b*), the detector 4 outputs signals having a plus peak value x2 and a minus peak value y2. The signals x1, y1, x2, and y2 are held by the peak value holding circuits 9 and 10. Then the arithmetic circuit 11 subtract the plus peak value x2 from the plus peak value x1, and the minus peak value y2 from the minus peak value y1. The resulting signal is virtually equal to zero in level as shown in FIG. 4(*c*). The decision circuit 12 judges that the signal is below the reference value.

Figure 5:
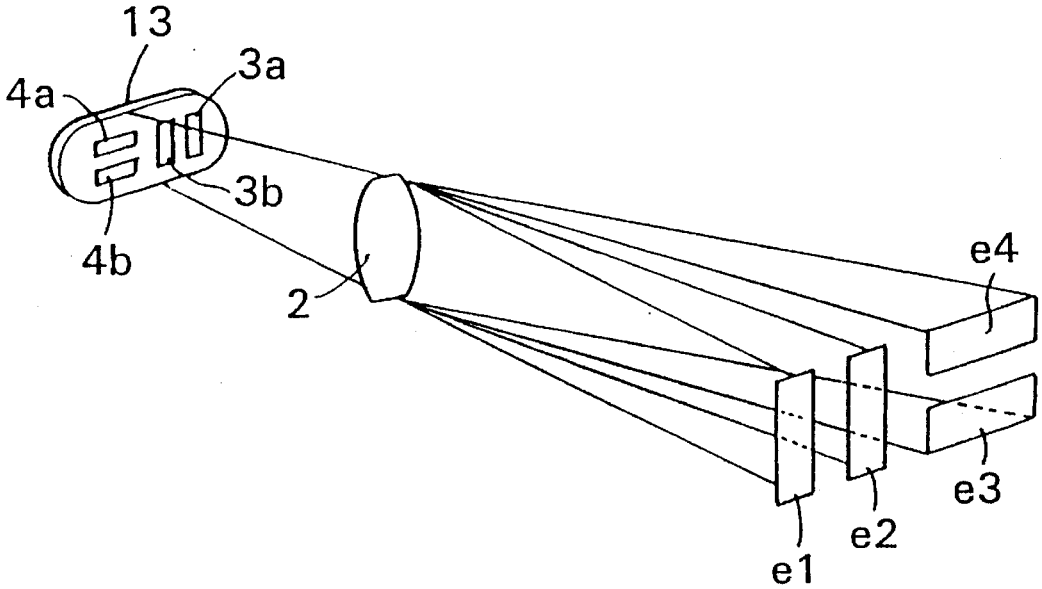
FIG. 5 is a diagrammatic view exemplifying a second example of the embodiment.

Referring to FIG. 5, a second example of the embodiment will be described wherein like reference numeral denote like components and elements to those in FIG. 1:

This example is different from the first example in that the sensors 3*a*, 3*b*, 4*a*, and 4*b* are mounted on a single detector 13. The circuit is the same as that of FIG. 2. The waveforms of signals are also the same as those shown in FIGS. 3 and 4. This example can save the space in the system.

Figure 6:
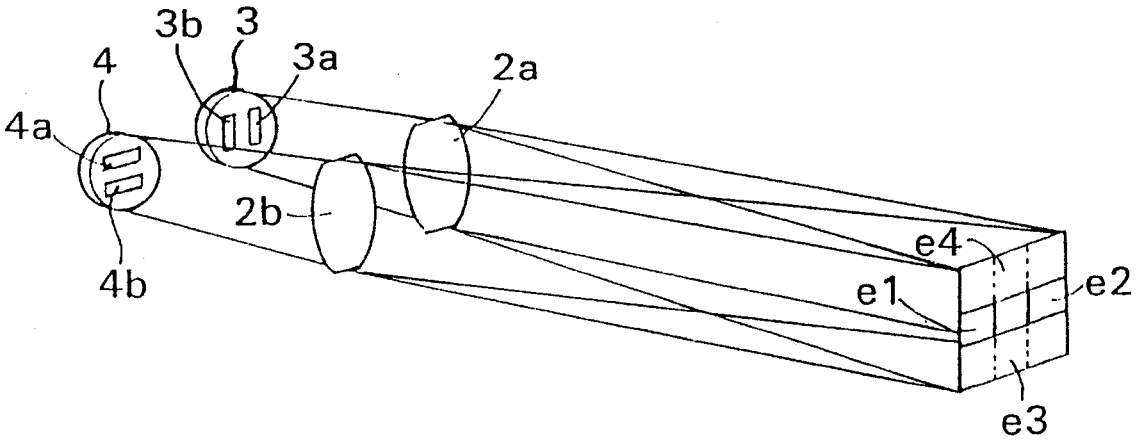
FIG. 6 is a diagrammatic view exemplifying a third example of the embodiment.
Figure 7:
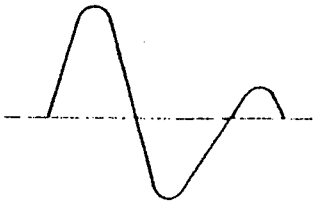
FIGS. 7(*a*) to 7(*c*) show the waveforms of signals generated when a human passes through detection regions.
Figure 7:
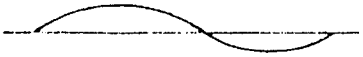
Figure 7:
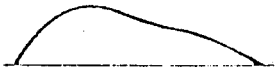

Referring to FIG. 6, a third example will be described wherein like reference numeral denote like components and elements to those in FIGS. 1 and 5:

This example is characterized in that two optical systems 2*a* and 2*b* are provided in correspondence to the detectors 3 and 4, respectively, and that the detection regions e1 to e4 are arranged in a block wherein the regions e1 and e2 partly overlap and the regions e3 and e4 partly overlap. The circuit used in this example has no peak holding circuits, and the arithmetic circuit 11 subtracts between absolute values of amplified signals output by the detectors 3 and 4. More specifically, when a human H passes through the detection regions, the detectors 3 and 4 output signals having the waveform as shown in FIGS. 7(*a*) and 7(*b*). The human H passes through the detection regions in the same manner as the cases of FIGS. 1 and 5, and the waveforms are substantially the same as those shown in FIGS. 3(*a*) and 3(*b*). The arithmetically processed signal has a waveform whose peak value exceeds the reference level as shown in FIG. 7(*c*). Because of the overlapping of the detection regions e1 and e2, and e3 and e4, the detectors 3 and 4 output signals at no time interval, thereby enhancing responsiveness to the passage of an moving object.

Figure 8:
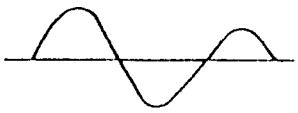
FIGS. 8(*a*) to 8(*c*) show the waveforms of signals generated when an animal passes through detection regions.
Figure 8:
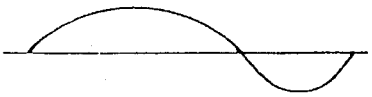
Figure 8:
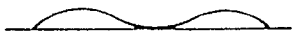

When a dog M passes through the regions, the signals output by the detectors 3 and 4 have the waveforms shown in FIGS. 8(*a*) and 8(*b*), which are substantially the same as those in FIGS. 4(*a*) and 4(*b*). In this example, the animal M passes through the detection regions in the same manner as seen in FIGS. 1 and 5. The arithmetically processed signal has the waveform shown in FIG. 8(*c*). While the animal H passes through the region e3, it first passes through the region e1 and then the region e2. A difference between the outputs corresponding to the regions e1 and e2 is represented in a waveform generated by the arithmetic circuit 11, and kept constant irrespective of changes in the ambient temperature. The peak value does not exceed a reference value.

Referring to FIGS. 9(A) and 9(B), a fourth example will be described wherein like reference numeral denote like components and elements to those in FIGS. 1, 5, 6. FIG. 9(B) is a fragmentary view showing, on an enlarged scale, the and arrangement of the sensors 14*a* to 14*d* to be mounted on the detector 14.

This example is different from the third example of FIG. 6 in that sensors 14*a* to 14*d* are mounted on a single detector 14, thereby reducing the size of the system. The detection regions d1 to d4 are also laid in block as in the third example.

Figure 10:
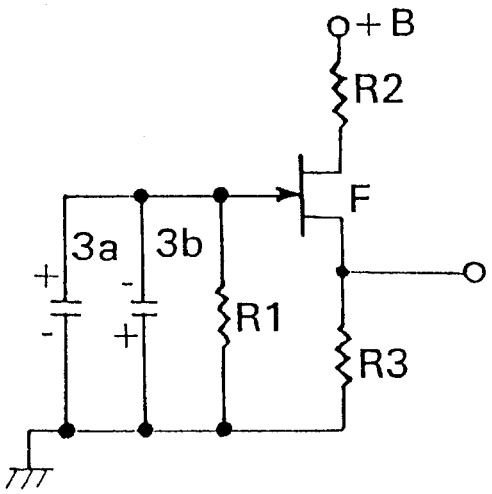
FIG. 10 is a circuit diagram of a light receiving surface.

In the illustrated embodiments, the sensors 3*a* and 3*b* are connected to each other in series with opposite polarity but as shown in FIG. 10 they may be connected in parallel with opposite polarity.

Figure 11:
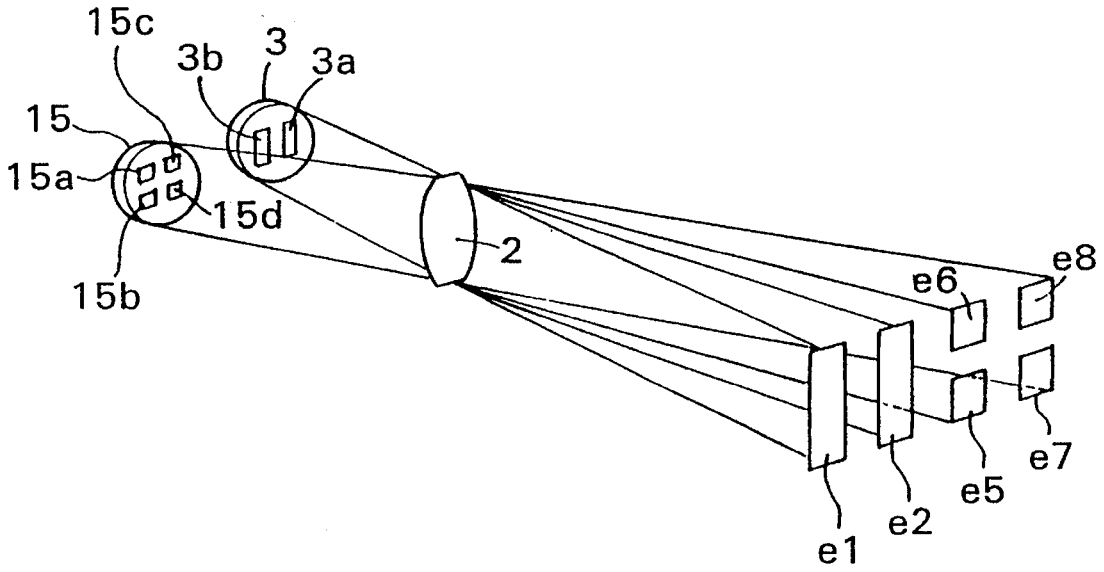
FIG. 11 is a diagrammatic view exemplifying a fifth example of the embodiment.
Figure 12:
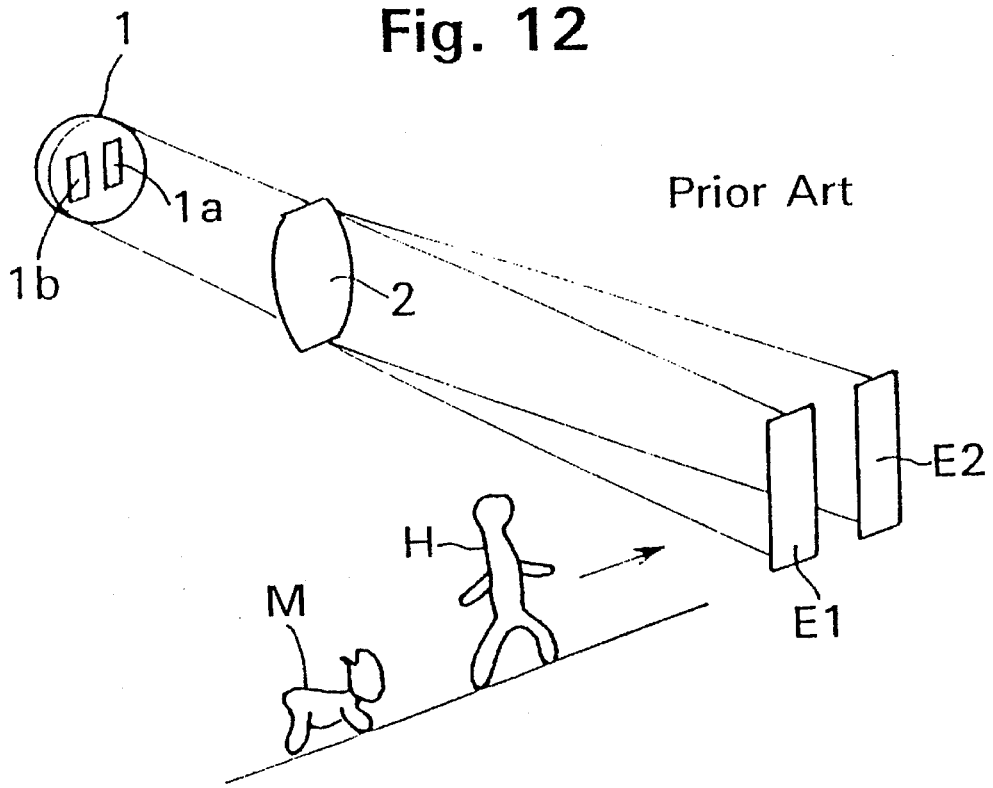
FIG. 12 is a diagrammatic view exemplifying a known moving object detecting system.
Figure 13:
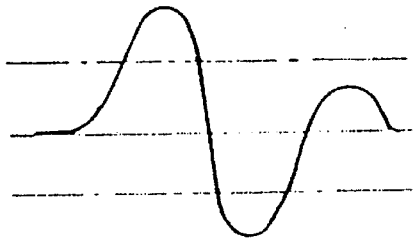
Prior Art Fig. 13 (A)
FIGS. 13(*a*) and 13(*b*) show the waveforms of signals generated when a human passes through detection regions, wherein there is a difference between the passer's body temperature and the ambient temperature.
Figure 13:
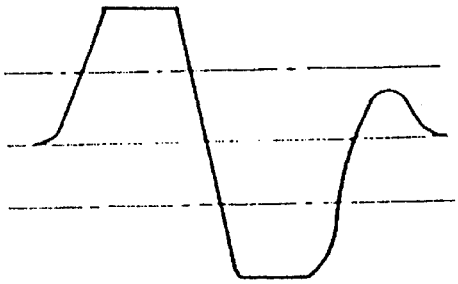
Prior Art Fig. 13 (B)
Figure 14:
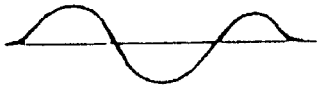
Prior Art Fig. 14 (A)
FIGS. 14(*a*) and 14(*b*) show the waveforms of output signals obtained when an animal passes through detection regions, wherein there is a difference between the passer's body temperature and the ambient temperature.
Figure 14:
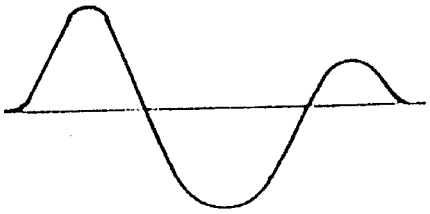
Prior Art Fig. 14 (B)

FIG. 11 shows a fifth example which is characterized in that a detector 15 having four sensors 15*a* to 15*d* of a square shape is additionally provided wherein the sensors 15*a* to 15*d* are located with spaces at each corner of a square. Detection regions e5 to e8 are arranged in a square corresponding to the sensors 15*a* to 15*d*. This example offers the same advantages as those obtained in the first and second examples.

Figure 9:
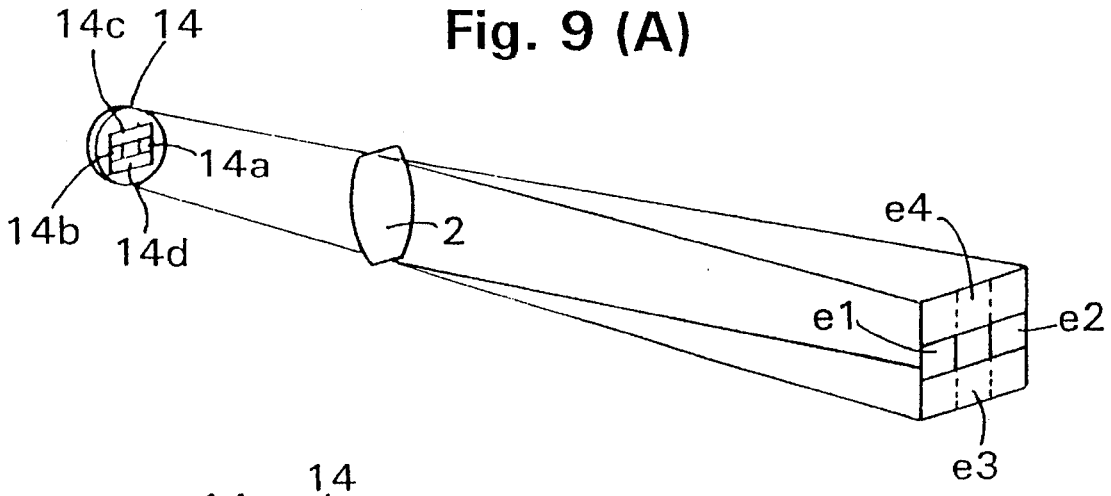
FIGS. 9(*a*) and 9(*b*) are explanatory views exemplifying a fourth example of the embodiment.
Figure 9:
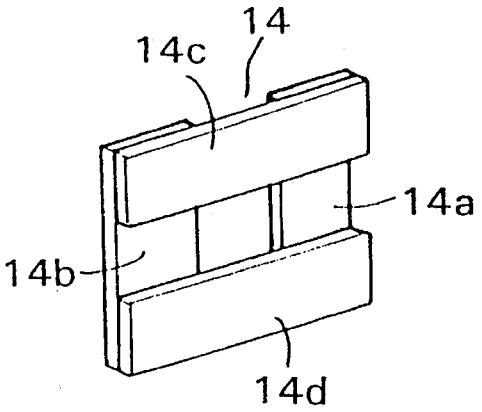

Referring to FIGS. 31(A) and 31(B), a modified version of the detection regions will be described in greater detail:

As described with reference to FIG. 9, the sensors 14*a* to 14*d* are mounted on a single detector 14. The sensor 14*a* overlaps the sensors 14*c* and 14*d* in its upper part and lower part. Likewise, the sensor 14*b* overlaps the sensors 14*c* and 14*d* in its upper part and lower part. These sensors 14*a* to 14*d* are preferably made of pyroelectric film. The sensors 14*a* and 14*b* are intended for detecting a human and the sensors 14*c* and 14*d* are for detecting a moving object other than a human. Detection regions A1 to A4 are arranged differently from those of FIG. 9. The sensors 14*a* to 14*d* optically correspond to the regions A1 to A4. Infrared ray radiating from each region is led to the overlapping parts of the sensors; more specifically, the overlapping parts of the sensor 14*b* receive infrared ray from the regions A1 and A2, and the overlapping parts of the sensor 14*a* receive it from the regions A3 and A4. The overlapping parts of the sensor 14*c* receive it from the regions A1 and A3. The overlapping parts of the sensor 14*d* receive it from the regions A2 and A4.

Figure 15:
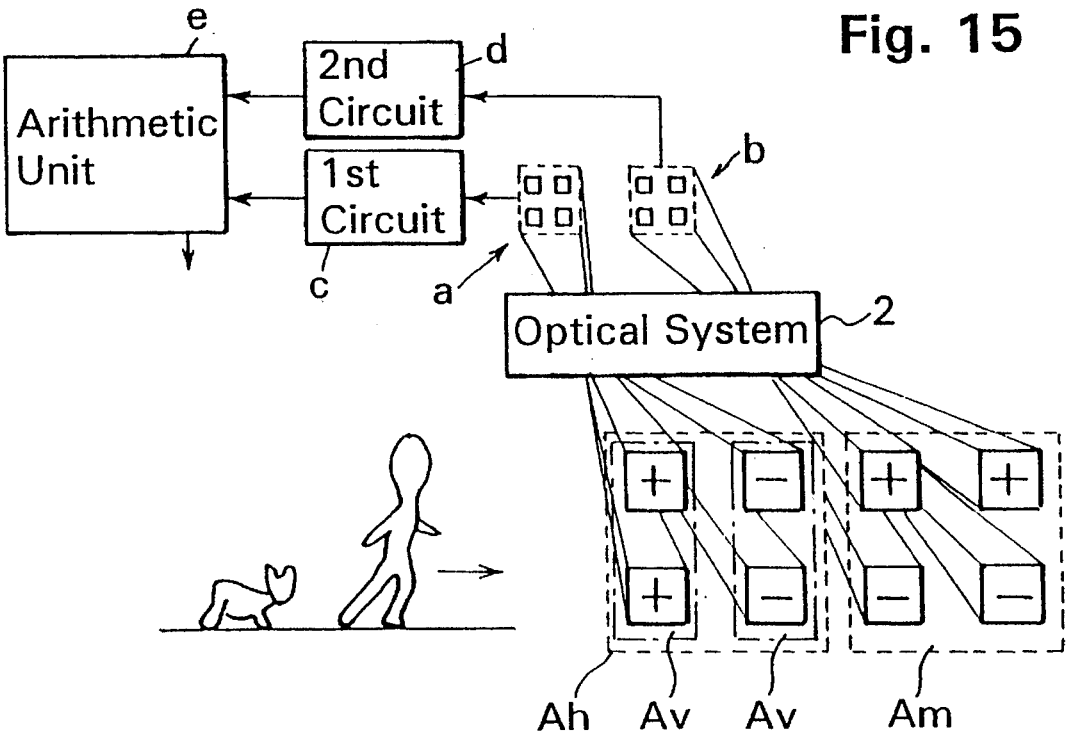
FIG. 15 is a diagrammatic view exemplifying a sixth example of the embodiment.

In FIG. 15, there are provided a group of sensors a for detecting a human intruder and a group of sensors b for detecting a non-human object such as a cat or a dog. The group a corresponds to a column detection region Ah which includes two columns Av spaced from each other. Likewise, the group b corresponds to a column detection region Am which includes detection regions formed in matrix. A first circuit c sums up the outputs from each column in the column region Ah with opposite polarity. A second circuit d sums up the outputs from each column in the column region Am, wherein the same polarity is horizontally arranged and the opposite polarities are vertically arranged. If infrared rays of the same intensity radiate from the whole column region Am, the output values will be offset. An arithmetic unit e calculates a peak value of the output values from the circuits a and d or else a difference between the absolute values or ratios therebetween. When the calculated value exceeds a reference level, a warning signal is generated.

Figure 16:
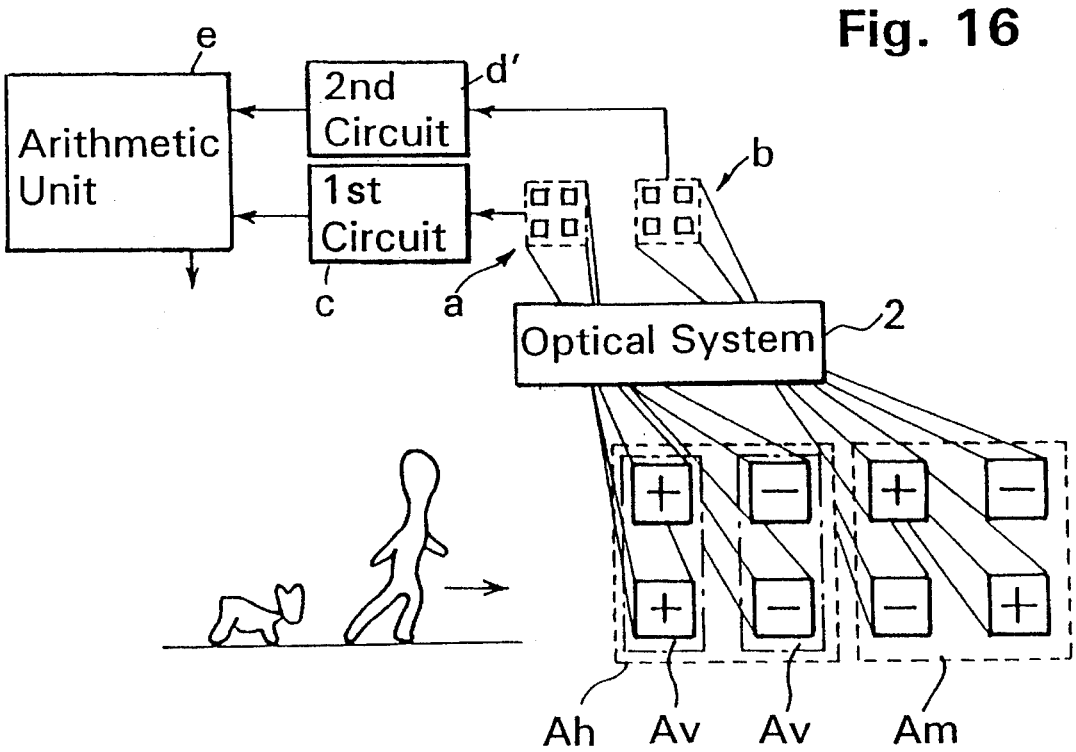
FIG. 16 is a diagrammatic view exemplifying a seventh example of the embodiment.

In FIG. 16, the second circuit d' is used instead of the second circuit d in FIG. 15, corresponding to a modified arrangement of the region Am in which the opposite polarities are horizontally and vertically arranged for detecting a small animal such as a cat or a dog. As seen from FIGS. 15 and 16, the detection regions Am for detecting a small animal includes detection regions arranged in matrix.

Figure 17:
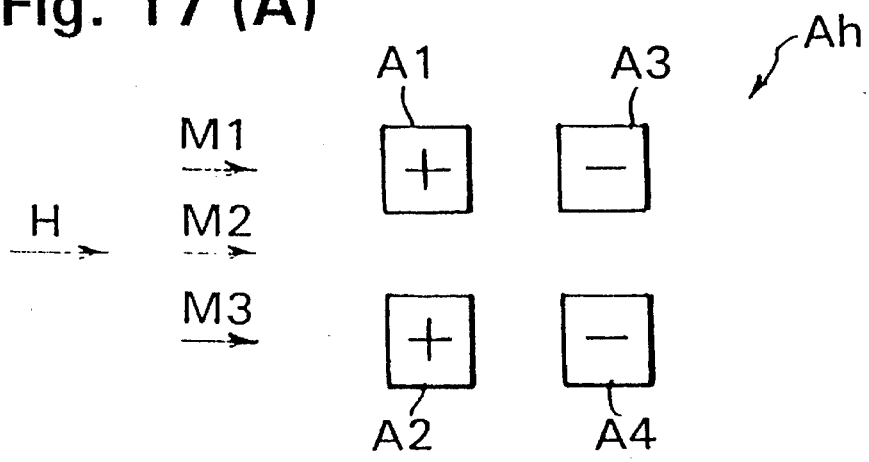
FIGS. 17(A) and 17(B) are views exemplifying the operation of a detection region group Ah for detecting a human.
Figure 17:
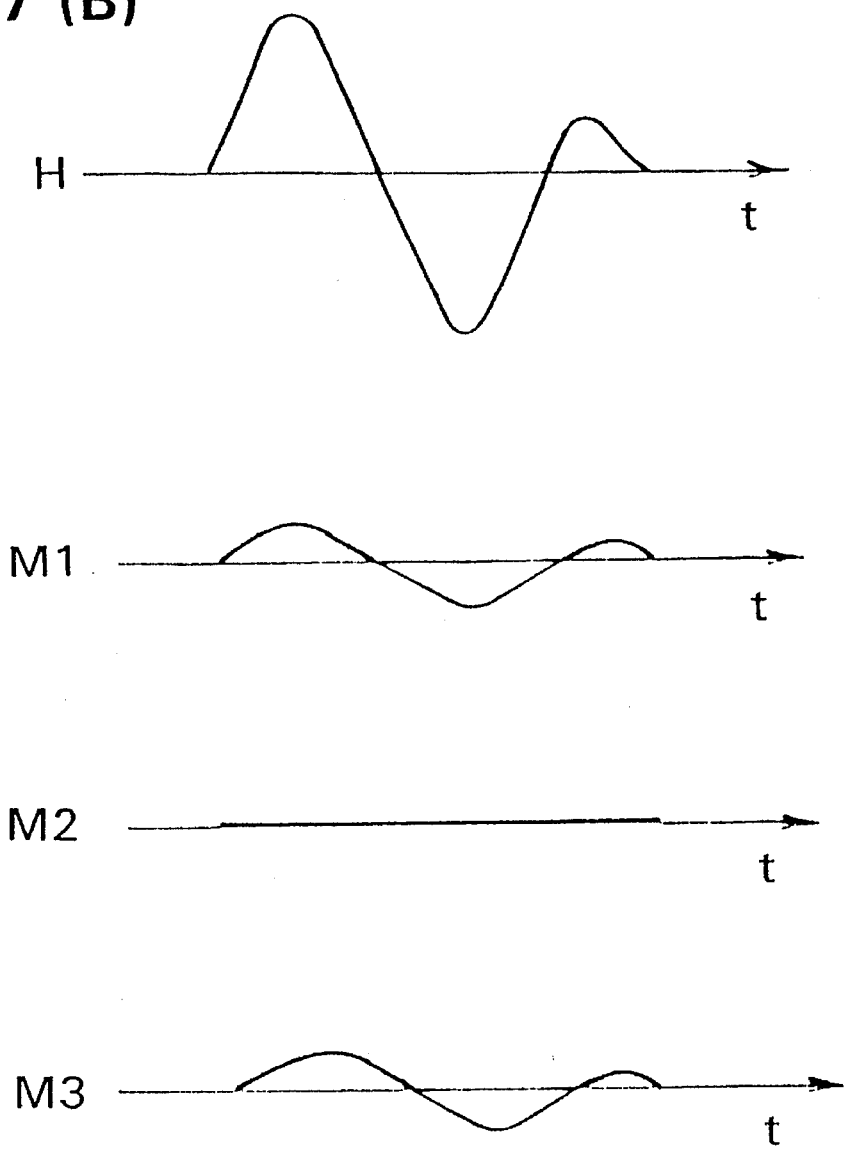
Figure 18:
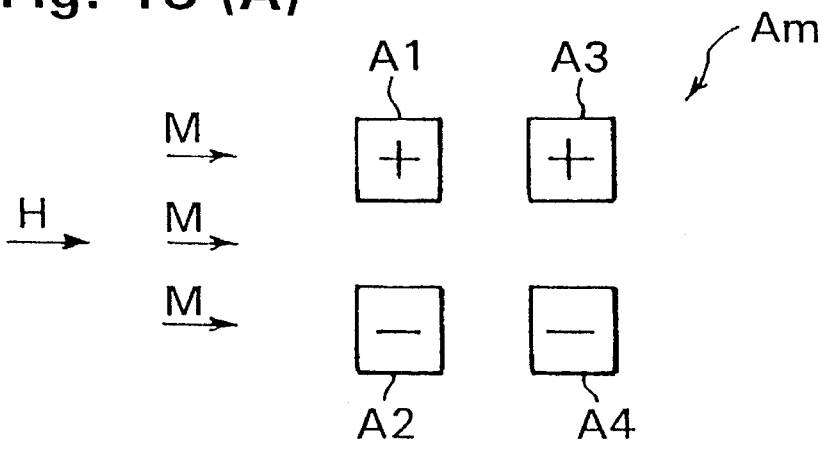
FIGS. 18(A) and 18(B) are diagrammatic views exemplifying the operation of a detection region group Am for detecting an animal.
Figure 18:
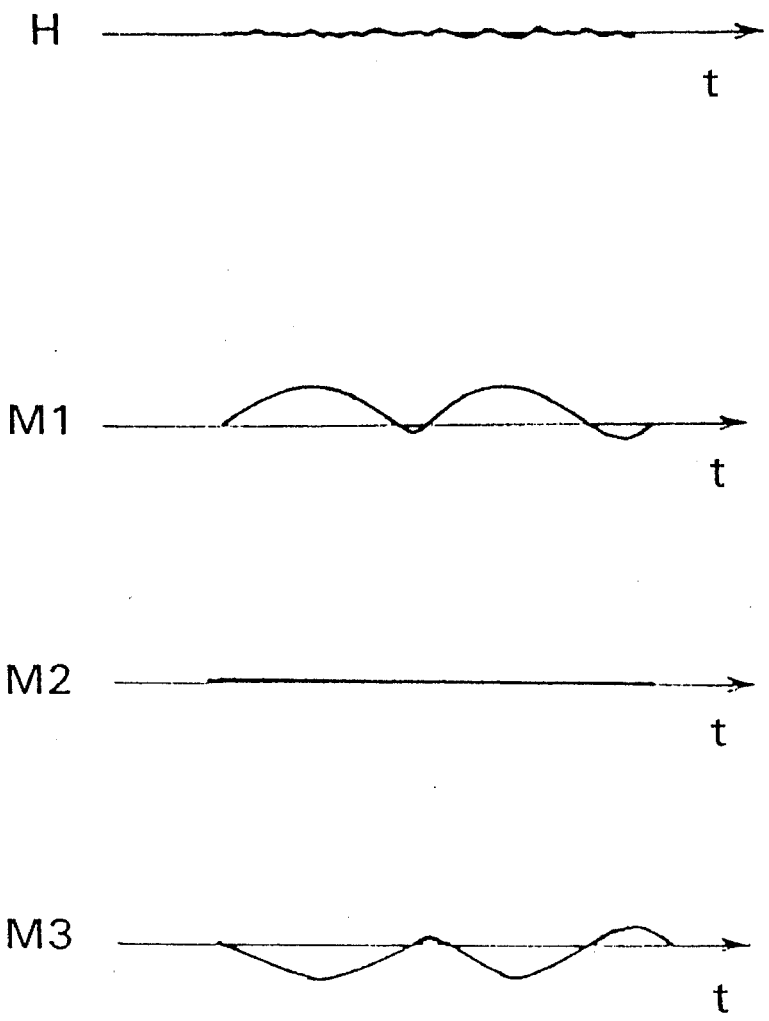

The detection field defined by the regions A1 to A4 has a human height. FIGS. 17(A) and 18(A) show the sums of outputs detected by the sensors for each polarity, wherein the regions for detecting a human is grouped as Ah and the regions for detecting an animal is grouped as Am.

The passage of a human H and an animal M through the respective detection regions causes the detector to produce the outputs shown in FIG. 17(B) and 18(B). When a human H walks in the direction of arrow and passes through the vertically arranged regions A1 and A2 (hereinafter, the vertical arrangement of detection regions will be referred to as "column"), and then the column of the regions A3 and A4. The passing human covers the whole space of the columns of regions A1–A2, and A3–A4. This is represented by a waveform with clearly distinctive plus and minus fluctuations as shown in FIG. 17(B).

The human H simultaneously passes through the group of region A1 and A2, and through the group of regions A3 and A4 as if they overlap each other. Since the regions A1 and A2, A3 and A4 are respectively differentially connected with opposite polarity, the outputs from the region group Ah and Am are mutually negated. This accounts for a flat waveform under the designation of H in FIG. 18(B), which means that no substantial change occurs.

As described above, the arithmetic circuit 11 make subtraction between the peak values of the outputs, and produces a waveform having distinctive plus and minus fluctuations.

When an animal M passes through the region group Ah, it passes through the regions A2 and A4 alone at a time interval or it passed through upper parts of the regions A1 and A3 alone (for example, when the animal walks on a wall or flies or jumps) at a time interval, the outputs vary as shown by M1 to M3 in FIG. 17(B).

Figure 19:
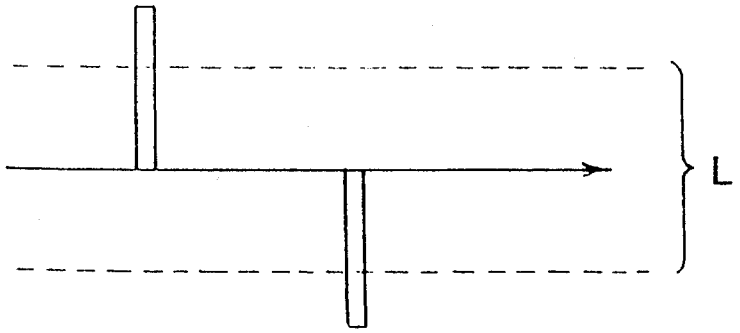
FIGS. 19(A) and 19(B) show the waveforms of signals output by arithmetic circuit.
Figure 19:
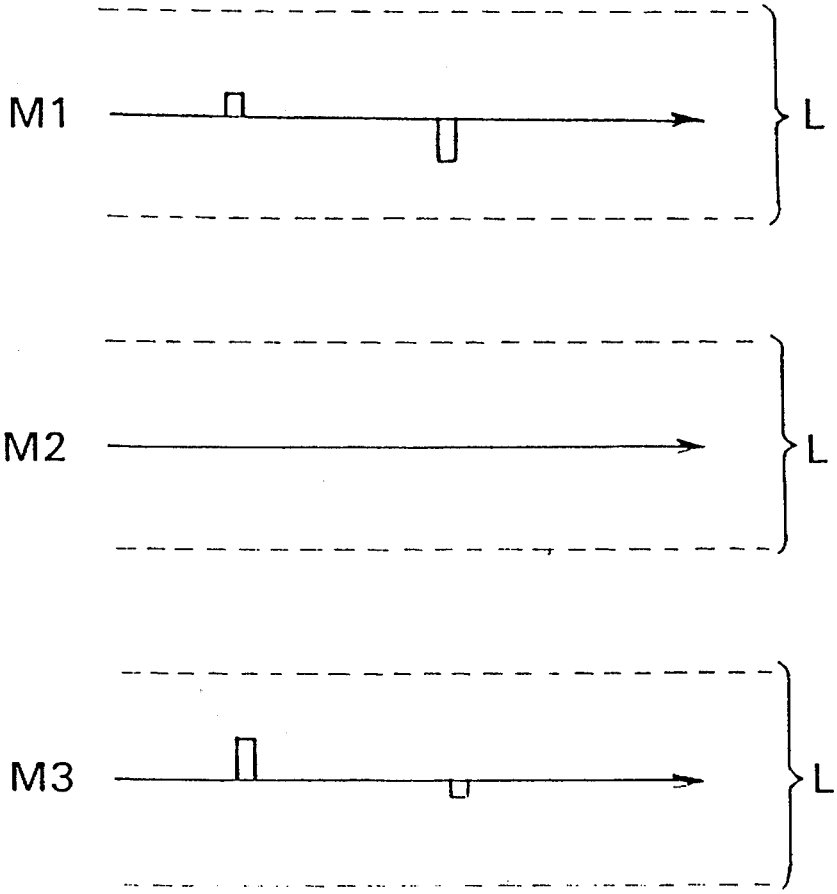

When an animal M passes through the region group Am, the signals output by the circuit 4 (FIG. 2) vary as shown in FIG. 18(B). The difference between the peak values is too small to be compared with the reference level L, as shown by contrasting FIG. 19(A) (passage of a human) and FIG. 19(B) (passage of an animal). Thus it is concluded that the intruder is an animal, thereby giving no alarm.

Figure 20:
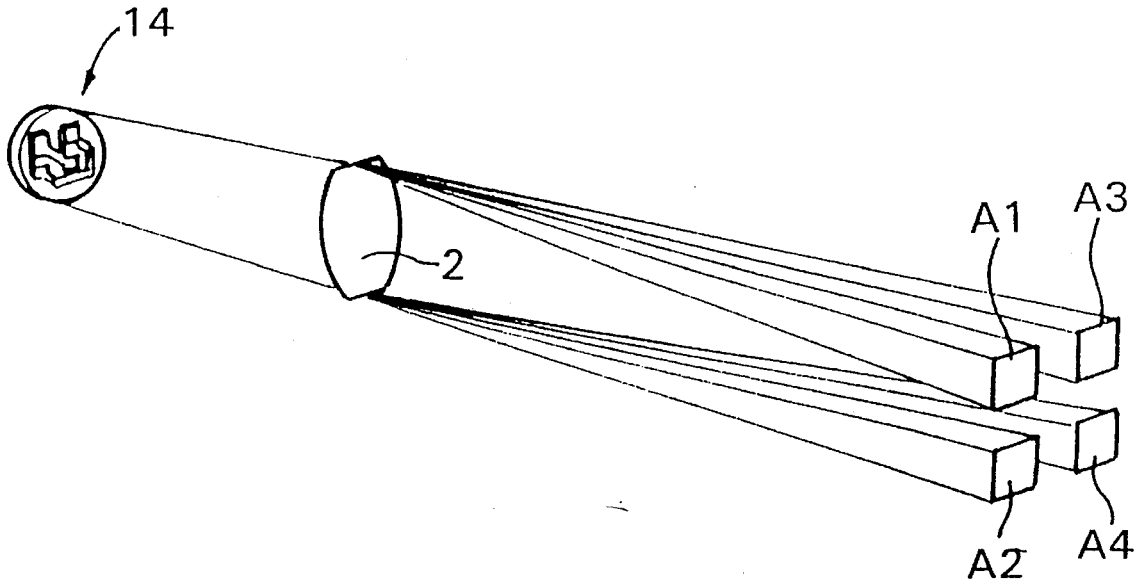
FIGS. 20(A) and 20(B) are diagrammatic views showing the optical arrangement of an eighth example of the embodiment.
Figure 20:
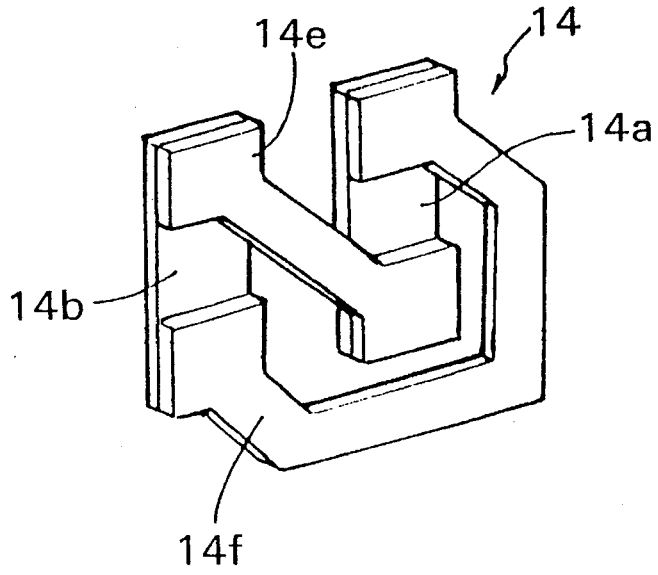

Referring to FIGS. 20(A) and 20(B), a modified version of the detector and sensors mounted thereon will be described:

The sensors 14*a* and 14*b* are vertically spaced from each other, and the diagonal corners of them are connected by the sensors 14*e* and 14*f*. The overlapping parts of these sensors 14*a*, 14*b*, 14*e* and 14*f* receive incident infrared ray from the detection regions A1 to A4 through the optical system 2.

Figure 21:
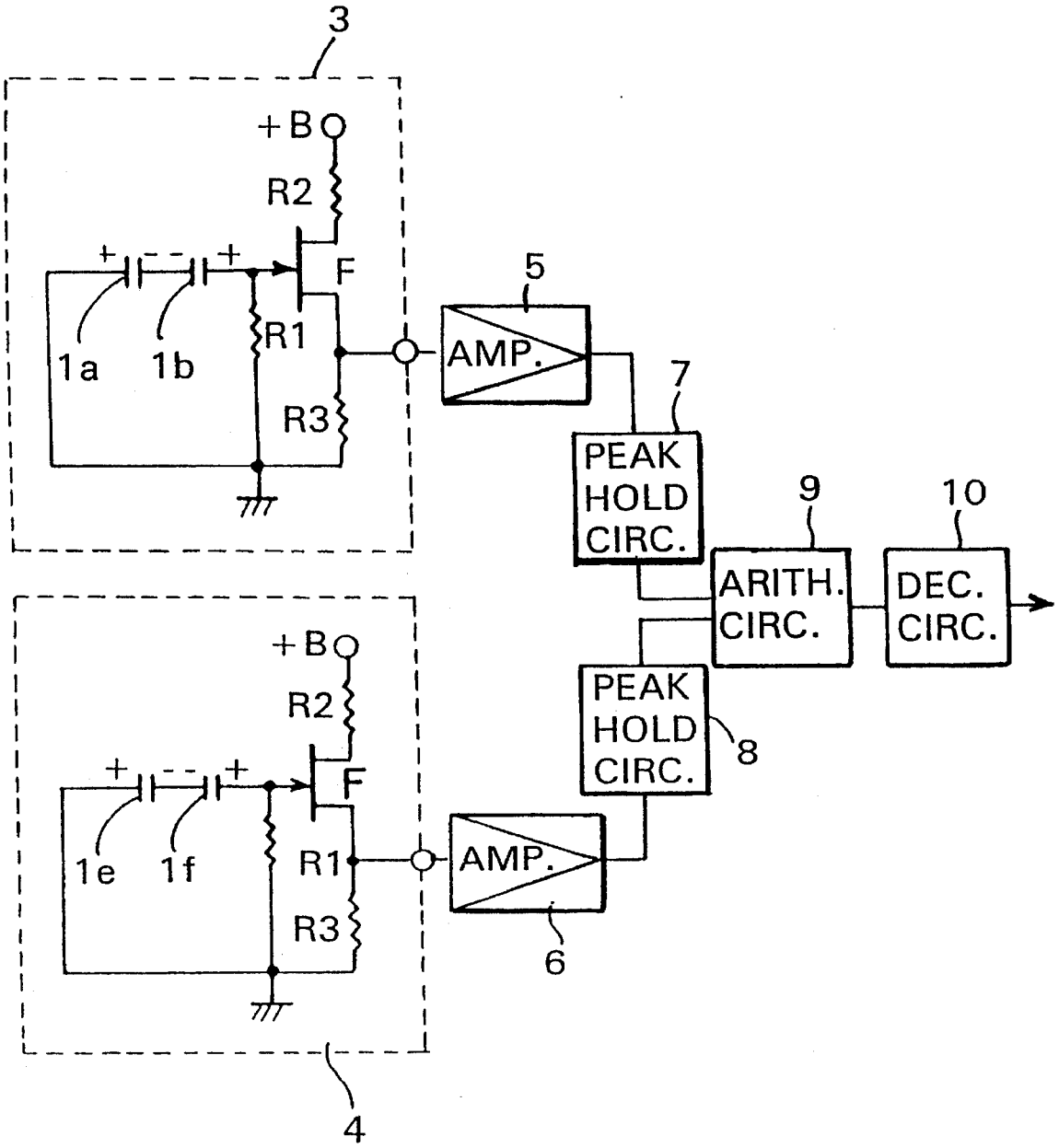
FIG. 21 is a circuit diagram used in the eighth example of the embodiment.
Figure 22:
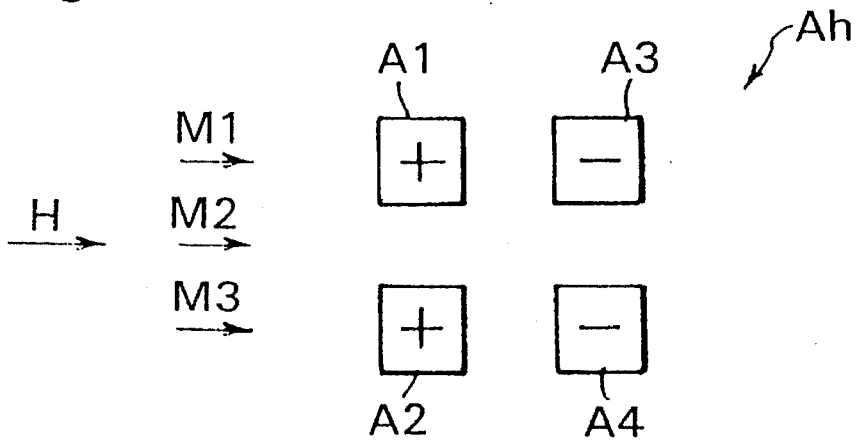
FIGS. 22(A) and 22(B) are diagrammatic views exemplifying the operation of a detection region group Ah for detecting a human in the second example.
Figure 22:
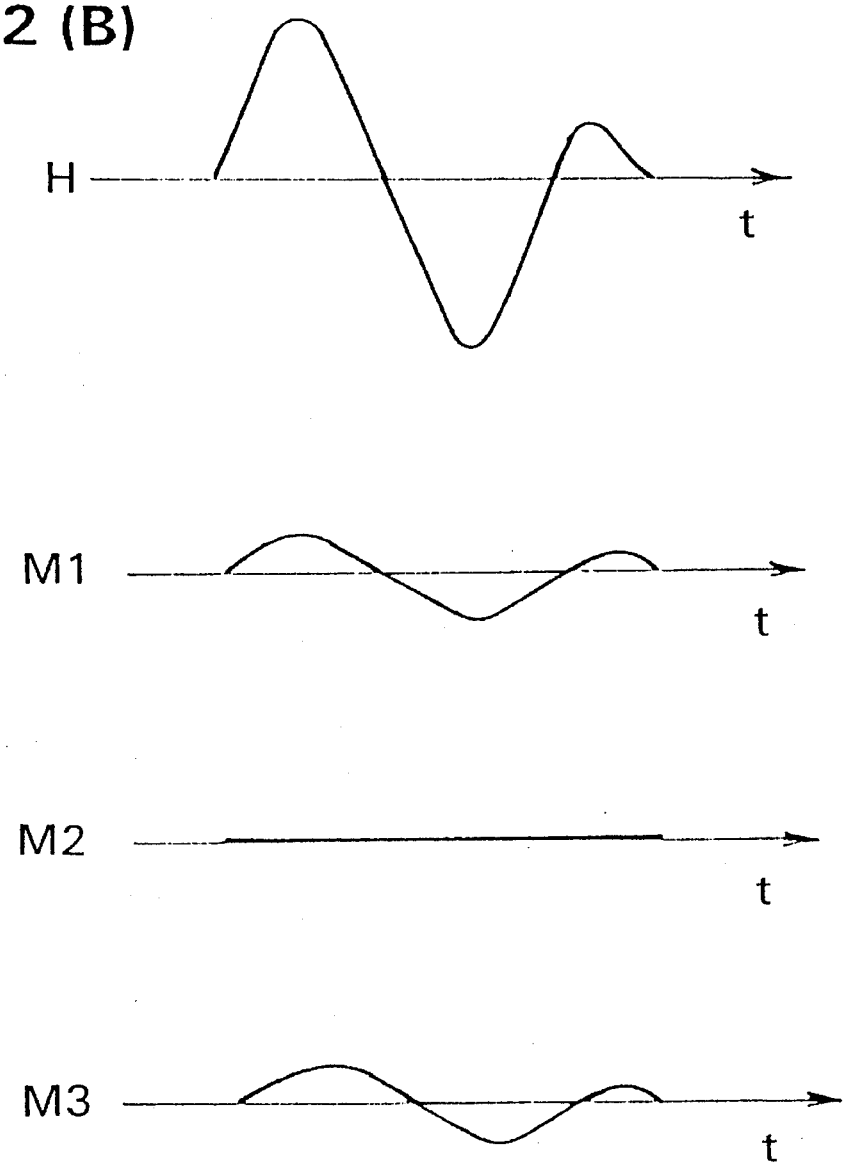
Figure 23:
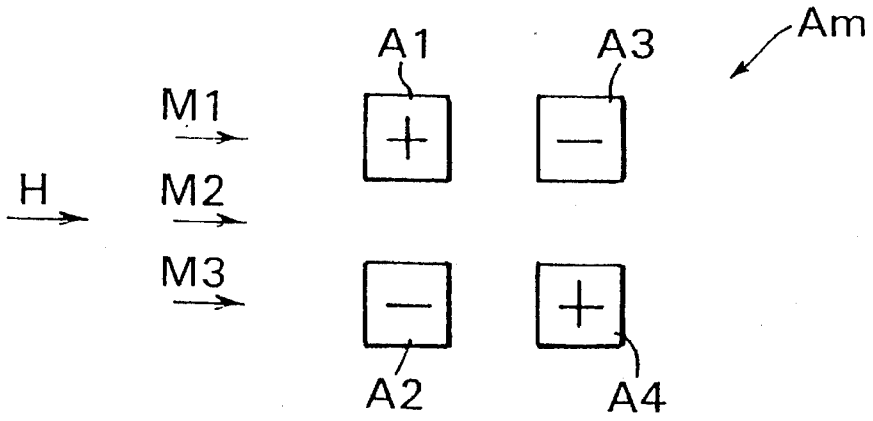
FIGS. 23(A) and 23(B) are diagrammatic views exemplifying the operation of a detection region group Am for detecting an animal in the second example.
Figure 23:
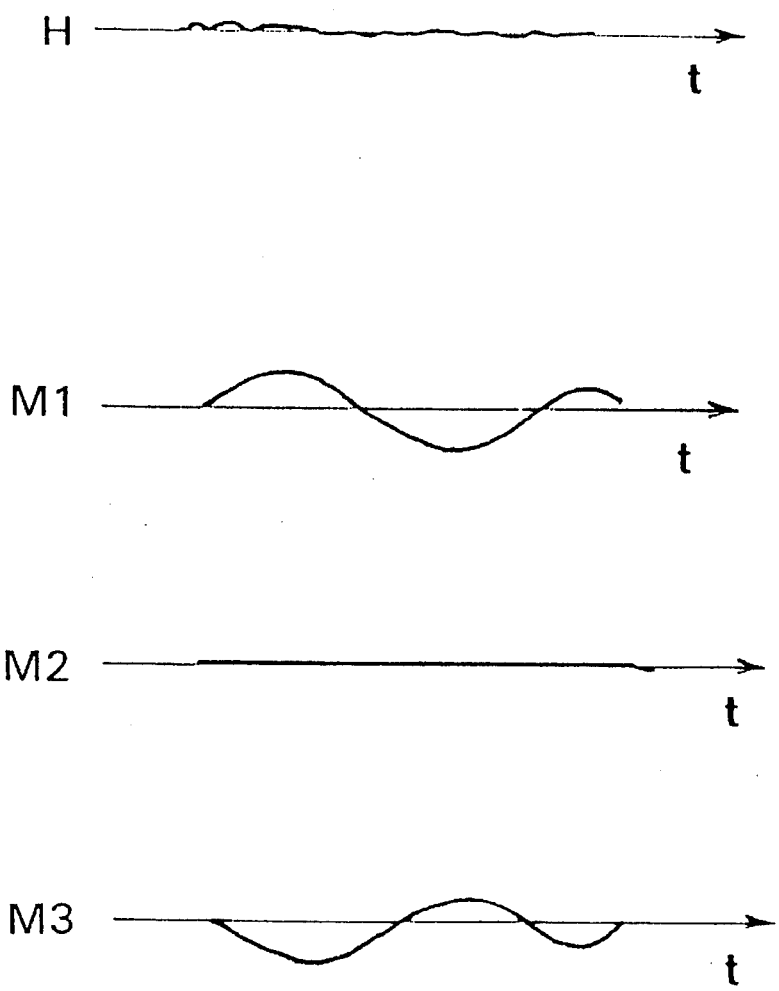
Figure 24:
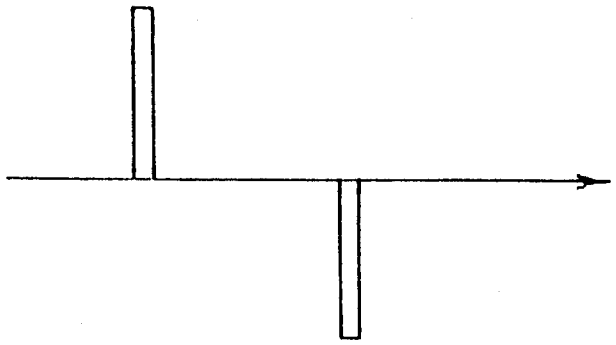
FIGS. 24(A) and 24(B) show the waveforms of signals output by the arithmetic circuit in the second example.
Figure 24:
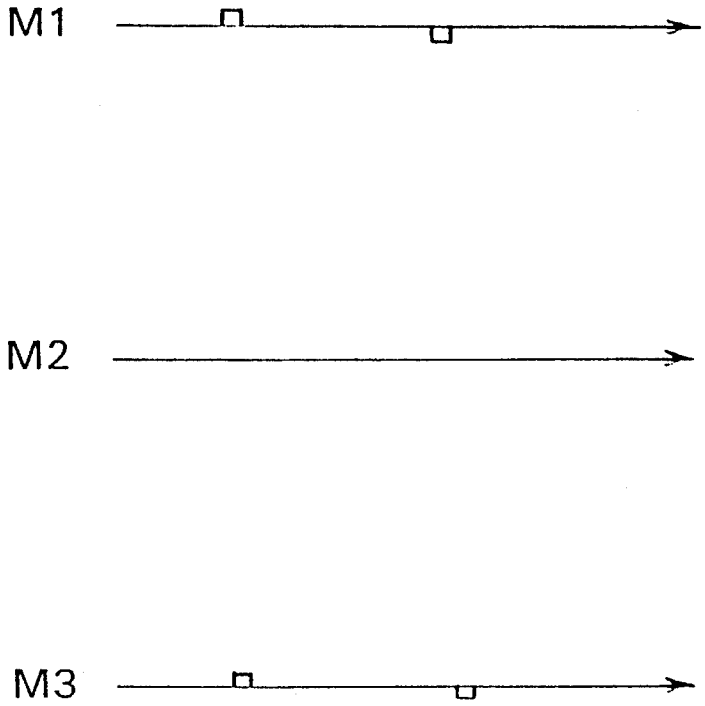
Figure 25:
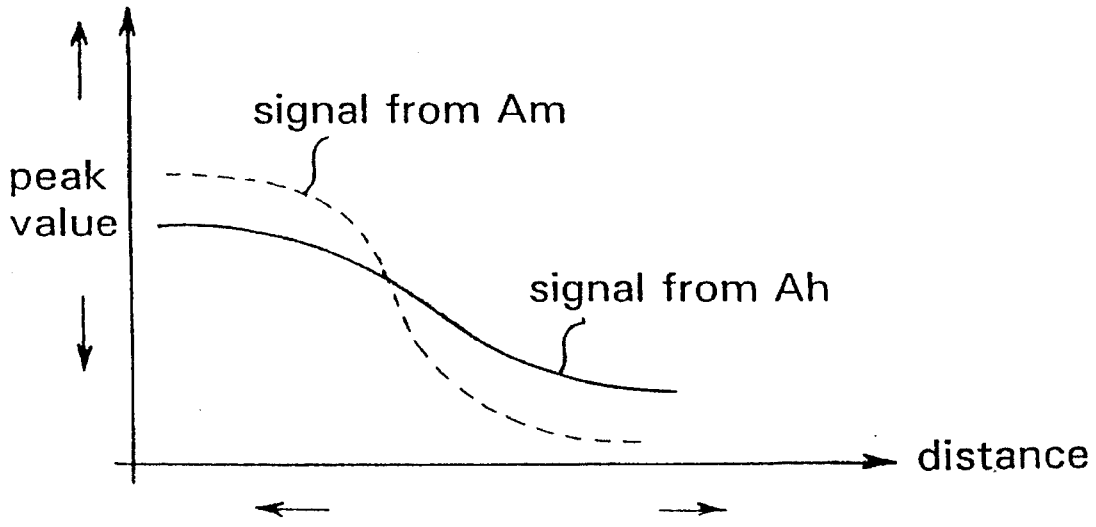
FIGS. 25(A) and 25(B) are graphs showing the operation of the second example of the embodiment.
Figure 25:
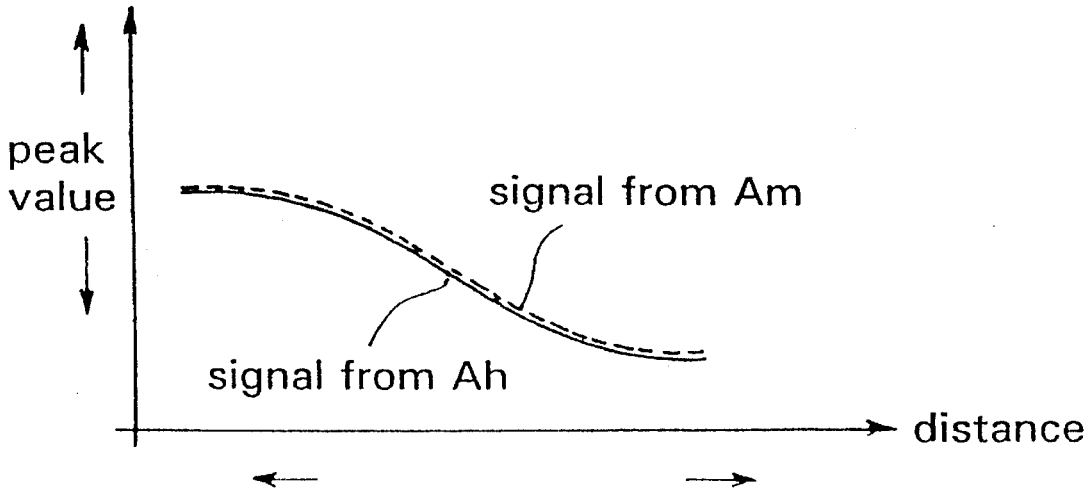

FIG. 21 shows a circuit diagram used in this example in which the sensors 14*a* and 14*b* are also connected in series with opposite polarity, as shown in FIG. 25(A). The resulting outputs for the arrangements shown in FIGS. 22(A) and 23(A) are shown in FIGS. 22(B) and 23(B). As shown in FIG. 24(A), when a human H passes through the detection region, the waveform of a signal has a clearly distinctive plus and minus fluctuations, whereas the passage of an animal M fails to produce a clearly distinctive waveform as shown in FIG. 24(B) and 25(B).

Figure 26:
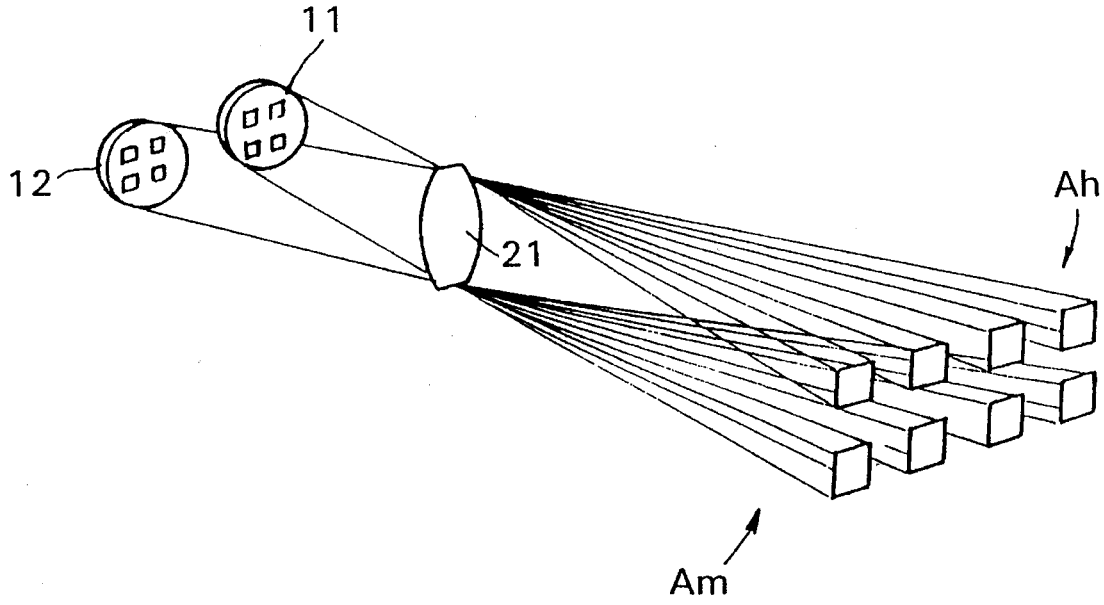
FIG. 26 is a diagrammatic view exemplifying an example of an optical arrangement of detection regions and detectors.
Figure 27:
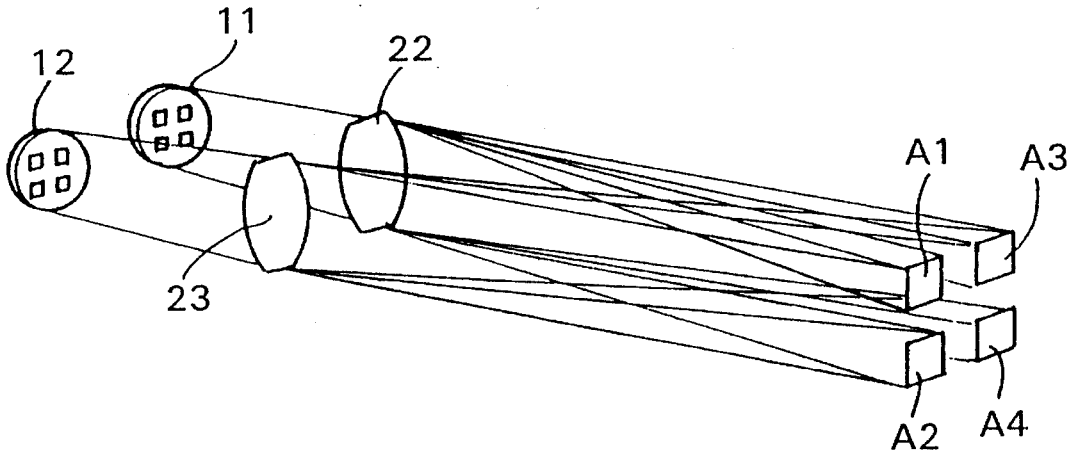
FIG. 27 is a diagrammatic view exemplifying another example of an optical arrangement of detection regions and detectors.
Figure 28:
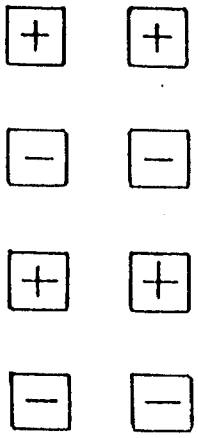
FIGS. 28(A) to 28(C), 29(A) to 29(C) and 30 are views showing various examples of the detection region group Am for a human.
Figure 28:
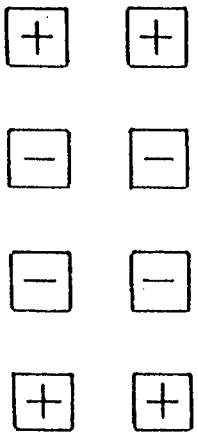
Figure 28:
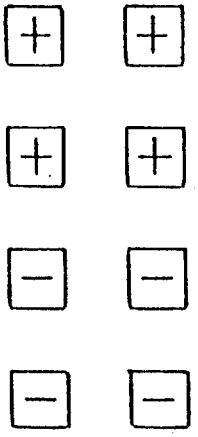
Figure 29:
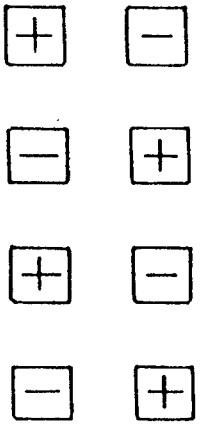
Figure 29:
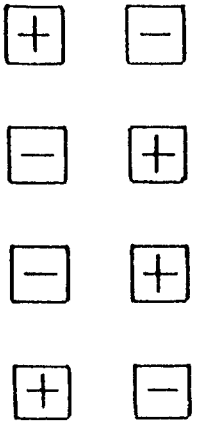
Figure 29:
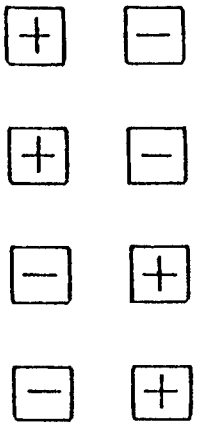
Figure 30:
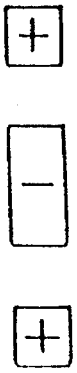

The partly overlapping detection regions are referred to above, but as shown in FIGS. 26 and 27, they may be arranged with spaces from one another wherein a single or a pair of optical systems correspond to the detectors 11 and 12. The number of detection regions in a column Ah is not limited to two each for detecting a human and an animal but can be three or more. If an even number of regions are arranged as shown in FIGS. 28(A) to 28(C) and FIGS. 29(A) to 29(C), they are arranged in each column in such a manner that the outputs from the detector 4 in response to the passage of a human are mutually negated to zero. If it is an odd number as shown in FIG. 30, they are arranged in such a manner that the total areas of plus and minus be equal to each other; for example, in FIG. 30, the total area of two plus regions is equal to that of a single minus region, thereby offsetting the outputs from the detector 4 to zero. In the illustrated embodiments, two detection regions are used in a column but three or more can be used. For the group Am, two detection regions in a row but three or more can be used.

According to the present invention, the passage of a human through a column of detection regions causes the detector to generate a high peak signal, and the subsequent passage through a row of detection regions causes the detector to generate a low peak signal. Subtraction is made between the two signals at the arithmetic circuit, and the resulting value is compared with a reference level. If it is found to exceed the reference value, it is recognized that the moving object is a human. If an animal passes in the same manner through the detection regions, the resulting signal has a low level nearly equal to zero. Distinction is readily made, thereby avoiding giving an alarm.

What is claimed is:

1. A passive type moving object detection system comprising:

an infrared detector;

infrared sensors mounted on the infrared detector;

a detection field including two columns of detection regions for monitoring a human intruder and two rows of detection regions for detecting a non-human intruder, wherein the columns of detection regions have a height covering a human height;

an optical system located between the infrared detector and the detection field;

the infrared sensors having infrared accepting areas comprising a first section and a second section wherein the first section optically corresponds to the columns of detection regions and the second section optically corresponds to the rows of detection regions, so as to receive infrared rays radiating from a moving object passing through the detection regions, the sensors including two columns of sensors and two rows of sensors, the columns of sensors optically corresponding to the columns of detection regions, and the rows of sensors optically corresponding to the rows of detection regions, wherein the columns of sensors are connected to each other with opposite polarity, and the rows of sensors are connected to each other with opposite polarity; and the detector including an arithmetic circuit which makes subtraction between the peak values of signals generated by the detector, and a decision circuit whereby the balance of subtraction is compared with a reference level.

2. The passive type moving object detection system according to claim 1, wherein the detection regions in columns and in rows partly overlap one another.

3. The passive type moving object detection system according to claim 1, wherein the sensors in the first section and the second section are mounted on a single detector in such a manner that they partly overlap each other.

4. A passive type moving object detection system comprising:

an infrared detector including groups of infrared sensors;

a detection field including two columns of detection regions having a human height and two rows of detection regions;

an optical system located between the infrared detector and the detection field;

the infrared sensors having infrared accepting areas comprising a first section and a second section wherein the first section optically corresponds to the columns of detection regions and the second section optically corresponds to the rows of detection regions, the infrared accepting areas receiving infrared rays radiating from a moving object within the detection regions;

a first circuit for totalling the outputs from the detection regions in the same column under same polarity, and totalling the outputs from the detection regions in different columns under opposite polarity;

a second circuit for totalling the outputs from the detection regions in the same row under same polarity, and negating the outputs from the detection regions in different columns under opposite polarity; and an arithmetic circuit for making subtraction between the peak values of signals from the first circuit and second circuit circuit whereby the balance of subtraction is compared with a reference level.

5. The passive type moving object detection system according to claim 4, wherein the detection regions in column and row partly overlap each other.

6. A passive type moving object detection system comprising:

an infrared detector including groups of infrared sensors;

a detection field including two columns of detection regions having a human height and two rows of detection regions;

an optical system located between the infrared detector and the detection field;

the infrared sensors having infrared accepting areas comprising a first section and a second section wherein the first section optically corresponds to the columns of detection regions and the second section optically corresponds to the rows of detection regions, the infrared accepting areas receiving infrared rays radiating from a moving object within the detection regions;

a first circuit for totalling the outputs from the detection regions in the same column under same polarity, and totalling the outputs from the detection regions in different columns under opposite polarity;

a second circuit for totalling the outputs from the detection regions in the same row under opposite polarity, and negating the outputs from the detection regions in different columns under opposite polarity; and an arithmetic circuit for making subtraction between the peak values of signals from the first circuit and second circuit circuit whereby the balance of subtraction is compared with a reference level.

7. The passive type moving object detection system according to claim 6, wherein the detection regions in column and row partly overlap each other.

* * * * *